US007635080B2

(12) United States Patent
Conway

(10) Patent No.: US 7,635,080 B2
(45) **Date of Patent: *Dec. 22, 2009**

(54) STACKABLE PAPERBOARD CONTAINER

(75) Inventor: Doyle A. Conway, Modesto, CA (US)

(73) Assignee: International Paper, Loveland, OH (US)

( * ) Notice: Subject to any disclaimer, the term of this patent is extended or adjusted under 35 U.S.C. 154(b) by 624 days.

This patent is subject to a terminal disclaimer.

(21) Appl. No.: 10/957,412

(22) Filed: Oct. 1, 2004

(65) Prior Publication Data

US 2005/0145687 A1 Jul. 7, 2005

Related U.S. Application Data

(63) Continuation-in-part of application No. 10/287,420, filed on Nov. 4, 2002, now Pat. No. 6,899,266.

(60) Provisional application No. 60/336,486, filed on Nov. 2, 2001.

(51) Int. Cl.
*B65D 21/032* (2006.01)

(52) U.S. Cl. ..... 229/169; 229/177; 229/178; 229/916; 229/918

(58) Field of Classification Search ..... None
See application file for complete search history.

(56) References Cited

U.S. PATENT DOCUMENTS 1,438,182 A * 12/1922 Kondolf ..... 229/194
2,350,932 A 6/1944 Shaefer
3,114,493 A 12/1963 Dunkin
3,899,121 A 8/1975 Herbetko
3,940,053 A 2/1976 Putman et al.
3,973,723 A 8/1976 Owens
4,151,948 A 5/1979 de la Fuente, Jr.
4,347,968 A 9/1982 Cornell et al.
4,356,952 A 11/1982 Rekow
4,418,863 A 12/1983 Kimbrell, Sr.

(Continued)

FOREIGN PATENT DOCUMENTS

EP 444 004 8/1991

(Continued)

*Primary Examiner*—Gary E Elkins
(74) *Attorney, Agent, or Firm*—Daniel C. Stelter; Thomas W. Ryan, III; Thomas W. Barnes, III

(57) ABSTRACT

A paperboard container folded from a single unitary blank of paperboard has a bottom wall, opposite side walls, and opposite end walls. Stacking tabs project from an upper edge of the end walls for receipt in corresponding slots in end edges of the bottom wall of an adjacent stacked container, and ventilation openings are formed in the side and end walls for circulation of air. The end walls are formed by inner and outer roll-over panels, and are slightly inwardly inclined to provide space for circulation of air between the containers when two of them are abutted together in end-to-end relationship. First extension flaps on the ends of the inner roll-over panels lie against and are secured to the inner surface of adjacent side walls, and second extension flaps on the ends of the side walls extend between and are captured by the inner and outer roll-over panels. In a preferred embodiment, the first extension flaps and the roll-over panels are held in place by interengaged detent tabs and slots.

19 Claims, 11 Drawing Sheets

U.S. PATENT DOCUMENTS

| | | | |
|---|---|---|---|
| 4,546,913 | A | 10/1985 | Castillo |
| 4,770,339 | A | 9/1988 | Weimer |
| 4,883,221 | A | 11/1989 | Brundage |
| 4,884,739 | A | 12/1989 | Nederveld |
| 4,911,355 | A | 3/1990 | Bannister |
| 5,002,224 | A | 3/1991 | Muise |
| 5,429,296 | A | 7/1995 | Southwell et al. |
| 5,458,283 | A | 10/1995 | Southwell et al. |
| 5,487,505 | A | 1/1996 | Nilsson |
| 5,535,941 | A | 7/1996 | Garza |
| 5,649,663 | A | 7/1997 | Pestow, Jr. |
| 5,673,848 | A | 10/1997 | Garza |
| 5,860,590 | A | 1/1999 | Blomfield et al. |
| 6,116,498 | A | 9/2000 | Sheffer |
| 6,158,652 | A | 12/2000 | Ruiz et al. |
| 6,302,323 | B1 | 10/2001 | Southwell |
| 6,604,675 | B2 | 8/2003 | Southwell |

FOREIGN PATENT DOCUMENTS

| | | | |
|---|---|---|---|
| FR | 1383824 | | 9/1963 |
| FR | 1383824 | | 11/1964 |
| FR | 2 651 482 | | 3/1991 |
| GB | 2 264 484 | A | 1/1993 |
| GB | 2 266 705 | | 11/1993 |
| GB | 2 267 697 | A | 12/1993 |

* cited by examiner

STACKABLE PAPERBOARD CONTAINER

This application is a continuation-in-part of application Ser. No. 10/287,420, filed Nov. 4, 2002, which claims the benefit of US provisional application Ser. No. 60/336,486, filed Nov. 2, 2001.

BACKGROUND OF THE INVENTION

1. Field of the Invention

The present invention relates to containers in general, and more specifically to stackable containers made of paperboard. In particular, the present invention relates to a ventilated stackable container that is easy to set up, has good structural rigidity, and uses less material in its construction than conventional containers.

2. Prior Art

Containers made of paperboard, i.e., corrugated cardboard, are commonly used in the produce industry to pack, store and ship fresh produce. These containers typically have a bottom, opposite side walls, opposite end walls, and either a closed or an open or partially open top, and when filled with fresh produce are placed on a pallet for shipping and handling. A standard pallet as used in the industry has a width of 40 inches and a length of 48 inches, and the containers are sized so that a plurality of containers can be placed side-by-side on the pallet. A typical container, for example, may have exterior width and length dimensions of about 20 inches by 16 inches, whereby six containers can be placed side-by-side on the pallet. Additional containers are then stacked on top of one another to form multiple layers of containers until a predetermined number of the filled containers are supported in stacked relationship on the pallet.

The loaded pallets may then be transported to a refrigeration unit to cool and/or store the fresh produce. To insure that all of the produce is appropriately cooled, the containers are provided with ventilation openings in at least some of their side, end and/or bottom walls, and are designed so that cooling air can circulate around, through and between the containers stacked on the pallet.

To enable the containers to be stacked on top on one another in stable relationship, stacking tabs are typically provided on the top or bottom edges of at least some of the side and/or end walls, and openings or notches are provided in the opposite edge for receipt of an aligned stacking tab on an adjacent stacked container. In addition to providing a positive detent to prevent lateral shifting of the stacked containers relative to one another, the stacking tabs also serve to index the containers for proper alignment when stacked.

Further, the loaded and stacked containers are subjected to considerable forces during shipment and handling, and must have sufficient structural strength and rigidity to withstand these forces. Thus, the side and/or end walls of the containers are usually constructed with multiple thicknesses, and/or additional reinforcing structure also may be provided, and the flutes of the corrugated material are typically arranged to extend vertically.

Moreover, the containers may be constructed for hand set-up or machine set-up. If intended for hand set-up, they should be easy for the operator to manipulate, and reliably secured in their erected form. In either event, they should be economical to make and use.

U.S. Pat. Nos. 5,485,283 and 5,860,590 are exemplary of prior art stackable containers. Both of them incorporate stacking tabs and at least one wall of double thickness. Additionally, they both have additional reinforcing structure in the comers for added stacking strength. U.S. Pat. No. 5,485,283 has ventilation openings through the side, end and bottom walls, and U.S. Pat. No. 5,869,590 has the opposite end walls inwardly inclined to permit circulation of air between containers arranged in side-by-side abutting relationship. The container in U.S. Pat. No. 5,458,283 utilizes multiple reversely folded panels, and thus consumes a substantial amount of material in its construction. The container in U.S. Pat. No. 5,860,590 requires adhesive to hold it in erected position.

There is need for a paperboard container that is stackable, structurally rigid, easy to set-up, reliably remains in set-up condition, and requires a minimum amount of material in its construction.

A container that meets these needs is disclosed in applicant's copending application Ser. No. 10/287,420. That container is stackable, has structural rigidity, is easy to set-up, reliably remains in set-up condition, and requires a minimum amount of material in its construction. In the particular embodiments disclosed therein, the side walls are of double wall construction, formed by inner and outer roll-over panels, and first flap extensions on opposite ends of the inner roll-over panels are folded inwardly and lie against the inner surface of the end walls. Second flap extensions on opposite ends of the end wall panels are folded inwardly and captured between the inner and outer roll-over panels. The first flap extensions are joined to the ends of the inner roll-over panel by a pair of spaced parallel folds, forming a diagonal panel in each corner of the container. These diagonal panels provide reinforcement and lend substantial stacking strength to the container. First tabs extend upwardly from the upper edge of the outer roll-over panels in spaced relationship along its length, and second tabs on the captured second flap extensions extend upwardly through the upper edge of the side walls and lie against the first tabs to form reinforced double thickness stacking tabs on the upper edge of the side walls. The side walls incorporating the roll-over panels and stacking tabs are inwardly inclined from about 2E to about 4E, whereby when two containers are placed in side-by-side abutting relationship with one another, space is formed between the abutting walls for circulation of cooling air. Notches in the upper edges of the side and end walls, and in some embodiments openings in the field of the walls, provide ventilation for circulation of cooling air through the container and produce held therein.

SUMMARY OF THE INVENTION

The container of the invention is substantially the same as the container disclosed in applicant's above-identified copending application, except that the roll-over panels and stacking tabs are on the end walls rather than the side walls. The location and capture of the extension flaps on the ends of the roll-over panels and the side walls is also reversed from that in the prior copending application. The relocation and reversal of parts from the prior container to the arrangement of the present invention provides all the advantages of the prior arrangement, i.e., the present container is stackable, structurally rigid, easy to set-up, reliably remains in set-up condition, and requires a minimum amount of material in its construction. In the particular embodiments disclosed herein, the end walls are of double wall construction, formed by inner and outer roll-over panels, and first flap extensions on opposite ends of the inner roll-over panels are folded inwardly and lie against the inner surface of the side walls. Second flap extensions on opposite ends of the side wall panels are folded inwardly and captured between the inner and outer roll-over panels. The first flap extensions are joined to the ends of the inner roll-over panel by a pair of spaced parallel folds, forming a diagonal panel in each corner of the container. These diagonal panels provide reinforcement and lend substantial stacking strength to the container. First tabs extend upwardly from the upper edge of the outer roll-over panels in spaced relationship along their length, and second tabs on the captured second flap extensions extend upwardly through the upper edge of the end walls and lie against the first tabs to form reinforced double thickness stacking tabs on the upper edge of the end walls. The walls incorporating the roll-over panels and stacking tabs, in this case the end walls, are inwardly inclined from about 2E to about 4E, whereby when two containers are placed in end-to-end abutting relationship with one another, space is formed between the abutting walls for circulation of cooling air. Notches in the upper edges of the side and end walls, and in some embodiments openings in the field of the walls, provide ventilation for circulation of cooling air through the container and produce held therein.

Locking tabs project downwardly from the bottom edge of the inner roll-over panels and extend into notches formed at the fold joining the end walls to the bottom of the container to hold the roll-over panels in position, and thus hold the second flap extensions and their associated side wall panels in erected position. A locking tab also projects from one edge of each diagonal panel and extends into a slit formed in the adjacent side wall panel to hold the first flap extensions and associated diagonal reinforcing panels in position. No adhesive is required, and manual set-up is very easy to accomplish. A minimal amount of material is used in construction, and once set up the container reliably remains in set up condition.

A first embodiment of the invention has essentially the structure described above, and has an open top.

In a second embodiment, lid panels are foldably joined to an upper edge of each of the side wall panels, and these lid panels are folded inwardly to lie over adjacent upper edges of the end walls, completely closing the top of the container. The lid panels are held in their inwardly folded closed position by engagement of the stacking tabs in notches in the end edges of the lid panels. To accomplish this, opposite side edges of the stacking tabs are undercut, and the edges of the notches in the lid panels engage in these undercut portions. The edges of the stacking tabs above the undercut portions are inwardly tapered to facilitate downward movement of the lid panel notches over the stacking tabs.

In a third embodiment, partial lid panels are foldably joined to an upper edge of each of the side wall panels, and each of these partial lid panels are folded inwardly to lie over adjacent upper edges of the end walls, partially closing the top of the container but leaving a space between their confronting edges for circulation of air. Bendable tabs or flaps are formed on the outer end edges of the lid panels, and shaped cuts form an opening in the bendable tabs at the folding juncture between the bendable tabs and associated lid panels. The partial lid panels are held in their inwardly folded closed position by engagement of the stacking tabs in these openings and by the bendable tabs, which are folded downwardly against an outer surface of the adjacent end wall. Additionally, reversely extending locking heels are formed by the shaped cuts, and these heels extend upwardly in coplanar relationship with the bendable tabs and lie against an outer surface of the stacking tabs. The locking heels maintain the bendable tabs in downwardly folded position and frictionally engage the stacking tabs to help hold the lid panels in their inwardly folded closed positions.

Although the bendable tabs and locking heels are illustrated and described in relation to the third embodiment wherein the container has partial lid panels, these features could equally as well be applied to the second embodiment.

Containers made in accordance with the invention are very strong, having excellent structural rigidity and stacking strength, and use approximately 11% less material than conventional containers. They are simple in construction, can be easily set up by hand, and once set up reliably remain in set-up condition.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
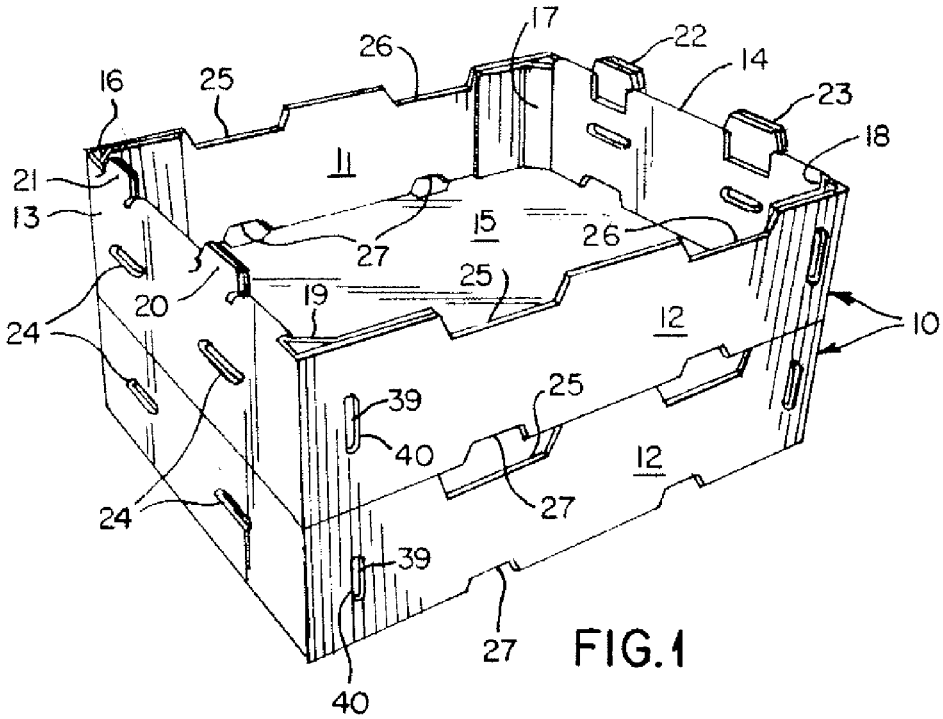
FIG. 1 is a top perspective view of a first and preferred embodiment of the invention, wherein the container has an open top.

A first and preferred embodiment of the container of the invention is indicated generally at 10 in FIGS. 1-12. The container has opposite side walls 11 and 12, opposite end walls 13 and 14, a bottom wall 15, and reinforcing interior diagonal corner panels 16, 17, 18 and 19 for enhanced stacking strength and torsional rigidity. Double ply stacking tabs 20, 21, 22 and 23 are spaced along the top edge of the end walls, and ventilation openings 24 are formed in the field of the opposite end walls. Recessed notches or cut-outs 25 and 26 in the top edges of the side walls, and aligned cut-outs or openings 27 at the folding juncture of the side walls and bottom wall provide additional ventilation openings for circulation of air, especially when the containers are stacked on top of one another as shown in FIG. 1.

Spaced openings or slots 28 are provided along the end edge of the bottom wall in alignment with the stacking tabs to provide receptacles for the stacking tabs of a subjacent container when the containers are stacked. The stacking tabs serve to prevent lateral shifting of the stacked containers and also index the containers into proper alignment when they are stacked with one another. The positioning of the openings 28 in the edge of the bottom wall and inside the plane of the respective side walls effectively encloses the stacking tabs when they are inserted into the openings.

The container 10 is simple in construction and uses a minimal amount of material, and yet has very good stacking strength and torsional rigidity. The end walls 13 and 14 are of triple wall thickness over most of their length, and comprise full length inner and outer roll-over panels 30 and 31, respectively, between which are sandwiched relatively long inwardly folded extension flaps 32 and 33 on opposite ends of the side walls 11 and 12, respectively.

The inner roll-over panels 30 each have extension flaps 34 and 35 on their opposite ends, traversed by pairs of relatively closely spaced parallel fold lines 36 and 37 positioned so that when the extension flaps 34 and 35 are folded inwardly alongside the inner surface of the respective side walls 11 and 12, the portion of the extension flaps between the parallel fold lines define the diagonal corner panels 16, 17, 18 and 19, which extend at about a 45° angle relative to the adjacent side and end walls.

A cut 38 is made in each extension flap 34 and 35 at the fold line 37, defining a tab 39 that projects from the fold line coplanar with the associated corner panel 16, 17, 18 or 19 when the extension flaps are folded into their operative set-up position, and these tabs 39 project into slots 40 formed in the adjacent side walls to hold the extension flaps 34 and 35 in their set-up positions alongside the inner surface of the respective side walls.

The roll-over panels are held in their inwardly folded set-up positions by a plurality of tabs 41 projecting from the bottom edge of the inner roll-over panel engaged in slots 42 formed along the end edges of the bottom wall 15. As seen best in FIGS. 2, 4, 9 and 10, cuts 43 extend perpendicularly away from the adjacent end wall panel and into the bottom panel 15 at opposite sides of the slots 42, defining flexible tabs 44 that yield or flex downwardly as the tabs 41 pass thereover when the inner roll-over panel is folded into its operative position, and then spring back up when the tabs 41 enter the slots 42, to lock the inner roll-over panel in operative position.

Cuts 45 are also formed in the bottom edge of inner roll-over panels 30 for registry with the stacking tab receiving slots 28 to prevent interference between the bottom edge of the inner roll-over panel and the stacking tabs when the stacking tabs are inserted into slots 28.

The double ply stacking tabs 20-23 are formed by first tabs 46 projecting upwardly from the upper edge of the extension flaps 32 and 33 and second tabs 47 that are cut from the inner roll-over panel, as described more fully below, and project upwardly from the fold 48 between the inner and outer roll-over panels. The fold 48 is formed by closely spaced parallel fold lines 49 and 50 that define between them roll-over bands 51 that wrap over the upper edge of the side walls and present a smooth, finished appearance to the edges. The tabs 47 are formed by cuts 52 and 53 extending from the upper edge of outer roll-over panel 31 through and beyond the fold lines 49 and 50 and into the inner roll-over panel, where the cuts terminate in a slot 54 located so that the tab 46 can pass through the slot when the roll-over panels are folded into their operative set-up position. When the roll-over panels are in their operative set-up positions, the tabs 47 project upwardly as a continuation of the outer roll-over panel and coplanar therewith, and the tabs 46 on the extension flaps 32 and 33 lie against the inner surface of the tabs 47 and reinforce them.

With particular reference to FIGS. 2-5 and 8, it can be seen that the ventilation openings 24 are formed by cut-outs 55 in the outer roll-over panel 31 that are in aligned registry with cut-outs 56 in the inner roll-over panel and with cut-outs 57 in the extension flaps 32 and 33 when the roll-over panels and extension flaps are in their operative set up position to form the end walls.

Manual set-up of the container 10 is easily accomplished. The extension flaps 32 and 33 are folded inwardly, or upwardly with reference to the blank in FIG. 3, and the side walls 11 and 12 are folded to an upright position relative to the bottom 15. The roll-over panel 31 is then folded upwardly alongside the extension flaps 32 and 33, and the roll-over panel 30 is folded downwardly over the extension flaps until the tabs 41 on the bottom edge thereof engage in the slots 42. At this time, the extension flaps 34 and 35 lie alongside the inner surface of the side walls 11 and 12, and the tabs 39 are inserted into the slots 40, assisting the tabs 41 in holding the inner roll-over panel in position. The diagonal corner panels 16-19 extend across the respective corners.

Figure 2:
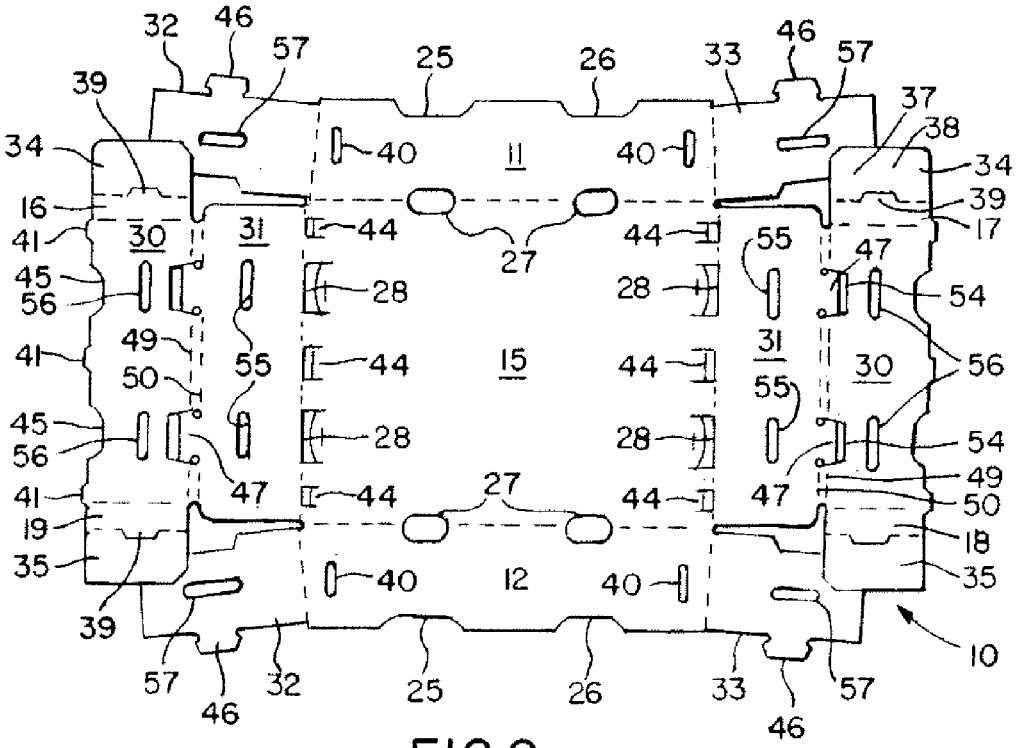
FIG. 2 is a plan view of the blank for making the container of FIG. 1.
Figure 3:
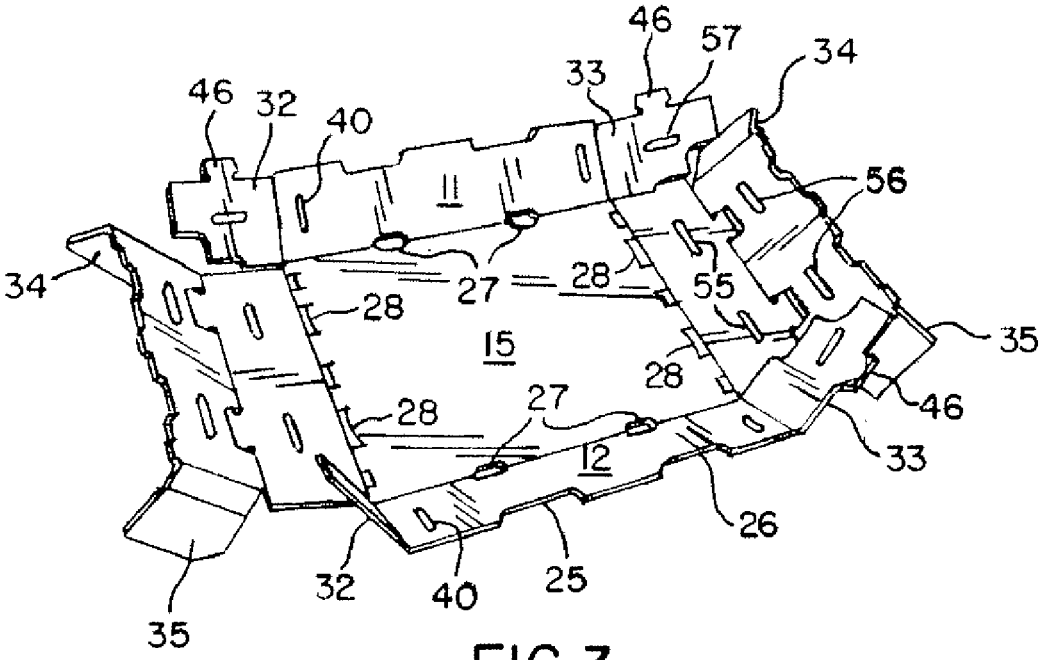
FIG. 3 is a top perspective view of the blank of FIG. 2, shown ready to be folded to its set-up condition.
Figure 4:
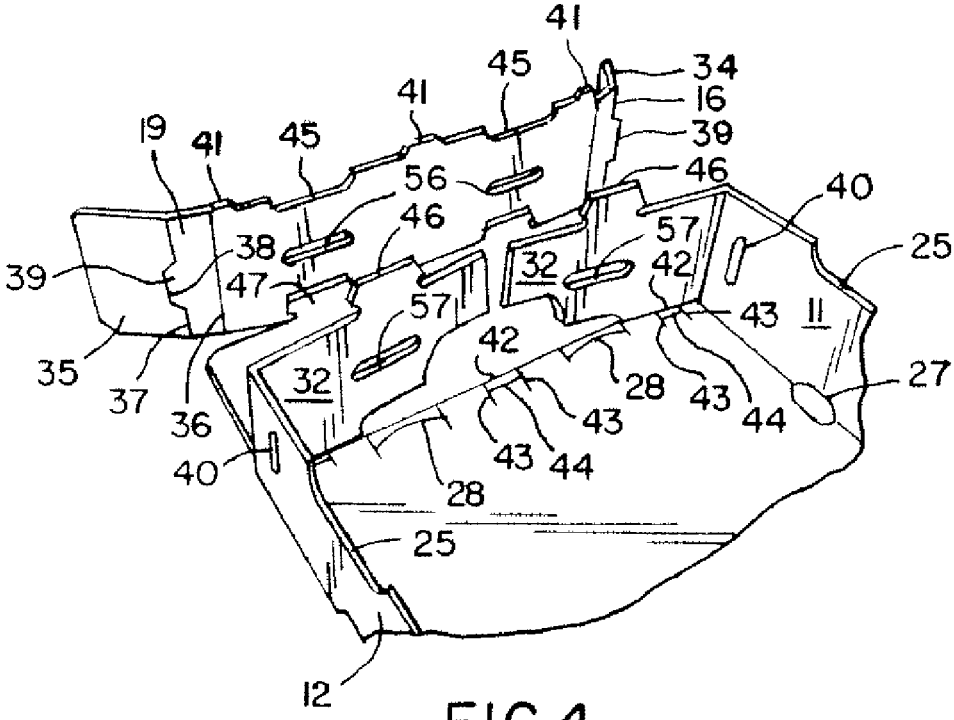
FIG. 4 is an enlarged, fragmentary, top perspective inside view of one end of the container of FIG. 1, shown with the side walls and their associated extension flaps folded upwardly and inwardly in a first stage of set-up.
Figure 5:
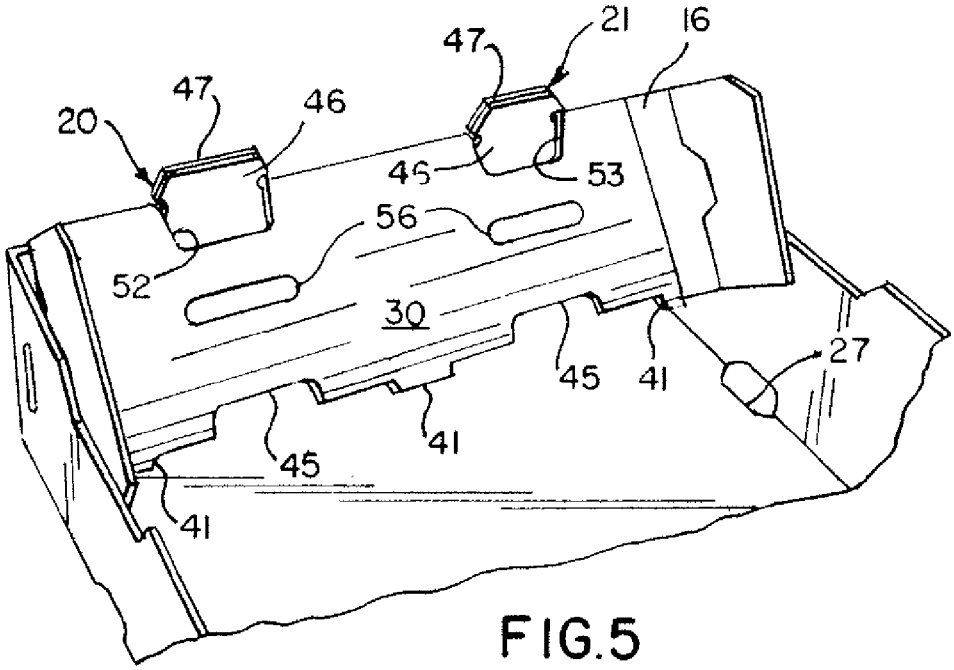
FIG. 5 is an enlarged, fragmentary, top perspective view of the container of FIG. 4, showing the end wall folded upwardly and inwardly against the extension flaps on the side walls, and the inner roll-over panel being folded inwardly and downwardly over the extension flaps in a second stage of set-up.
Figure 6:
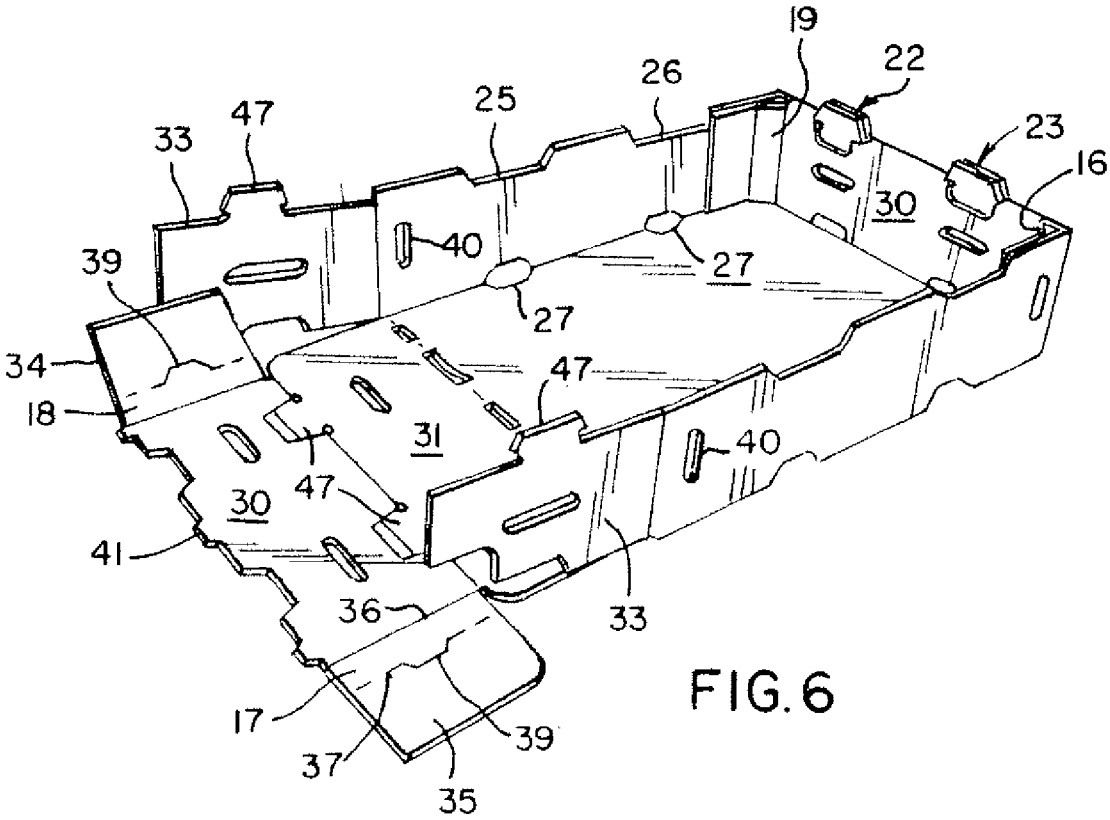
FIG. 6 is a top perspective view of the container of FIG. 1, with a first end of the container set up and showing the relationship of the extension flaps and inner outer roll-over panels at the second end preparatory to being folded into operative set-up position
Figure 7:
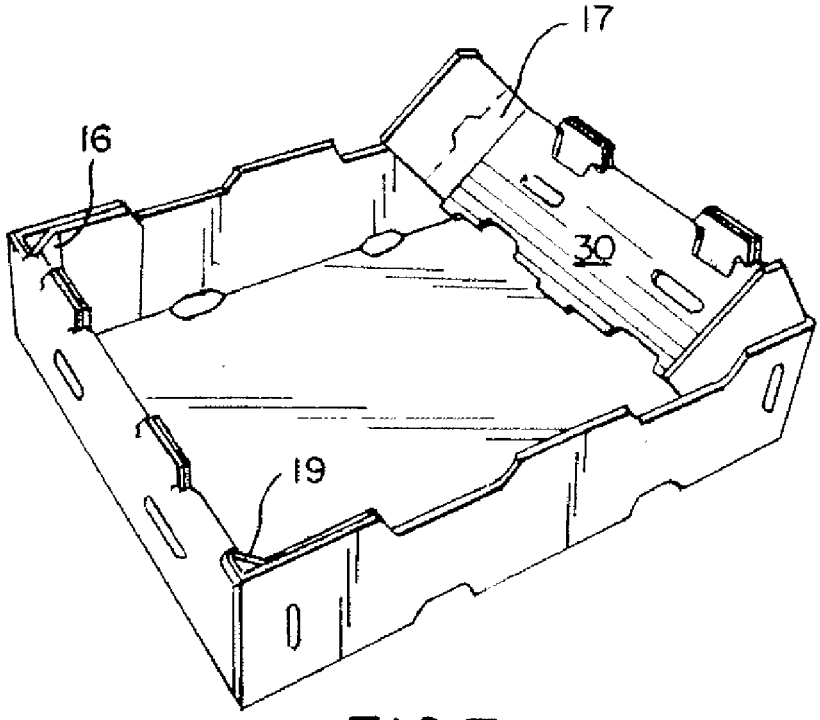
FIG. 7 is a top perspective view of the container of FIG. 6, shown turned end-for-end and with the second end of the container in partially set up condition.
Figure 8:
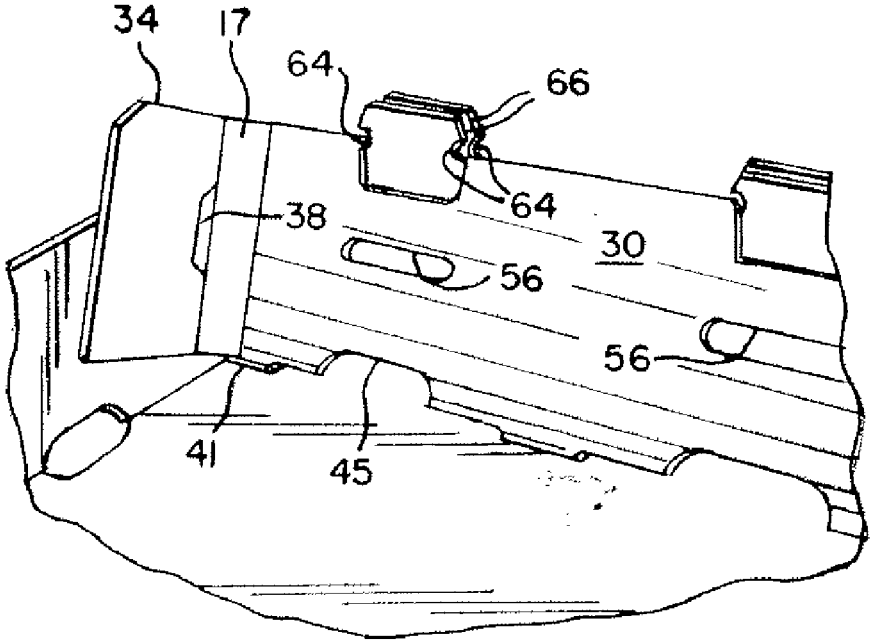
FIG. 8 is an enlarged, fragmentary, inside top perspective view of the second end of the container of FIG. 7, showing in greater detail features of the invention.
Figure 9:
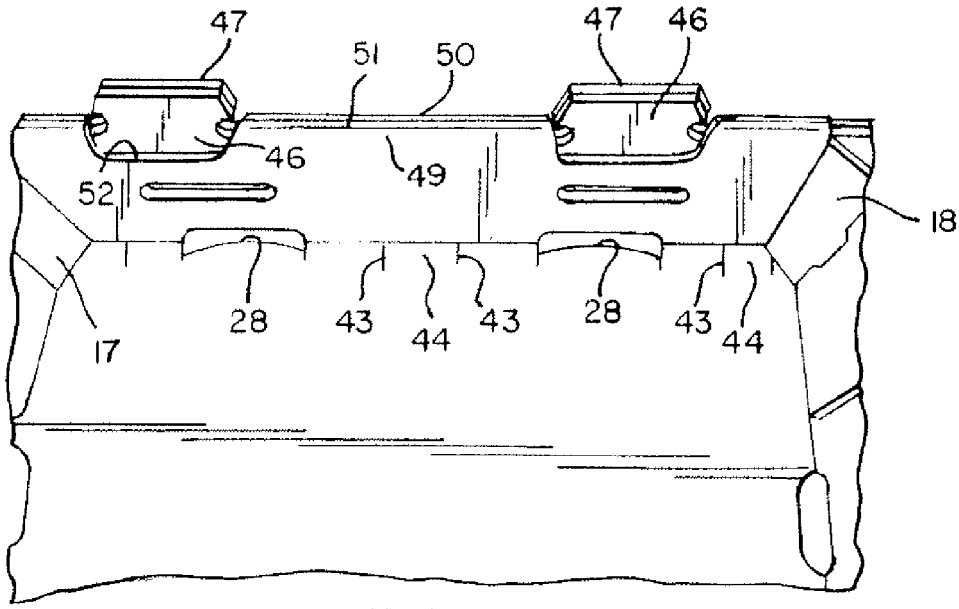
FIG. 9 is an enlarged, fragmentary, top view of an end of the container of FIG. 1, showing the slits in the ends of the bottom of the container that form locking structure to hold the locking tabs of the inner roll-over panel in place.
Figure 10:
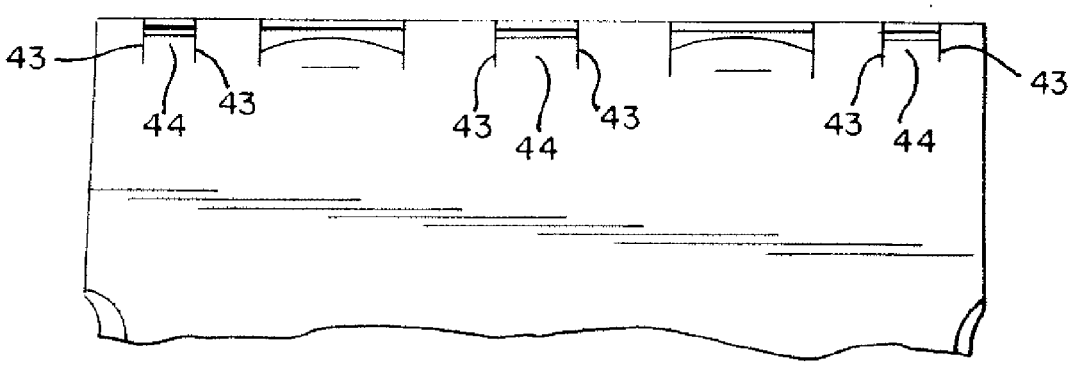
FIG. 10 is a bottom plan view of the end of the container shown in FIG. 9, illustrating the locking structure in the ends of the container bottom for holding the inner roll-over panel in place.
Figure 11:
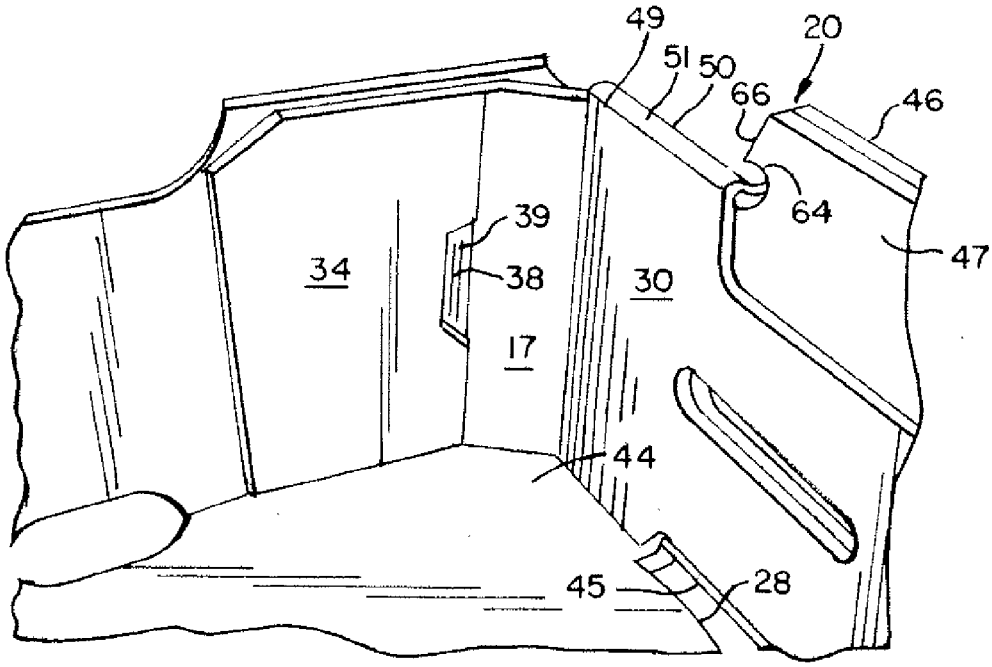
FIG. 11 is an enlarged, fragmentary, top perspective view showing the inside of one corner of the container of FIG. 1, illustrating details of an extension flap and associated locking tab on one end of the inner roll-over panel.
Figure 12:
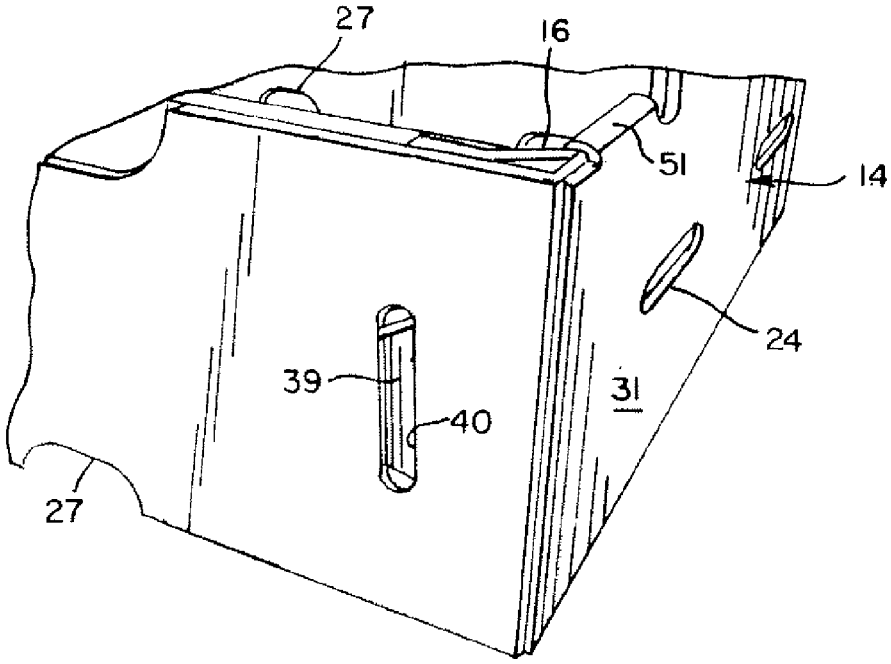
FIG. 12 is an enlarged, fragmentary, top perspective view showing the outside of the corner of the container shown in FIG. 11, depicting the locking tab and associated slot in the side wall of the container.
Figure 13:
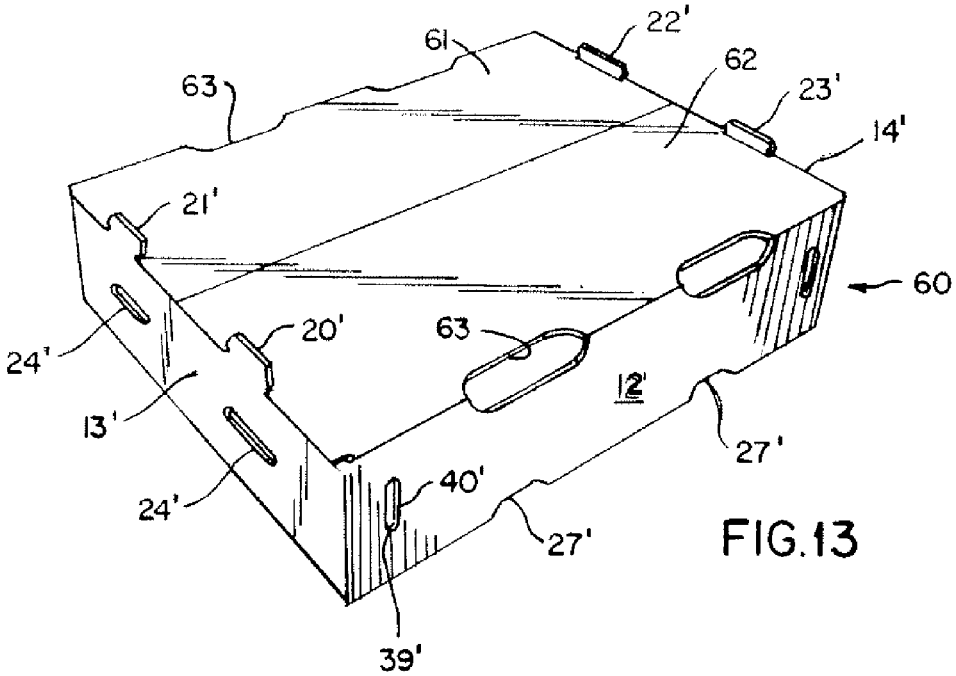
FIG. 13 is a top perspective view of a second embodiment of the container of the invention, wherein the container has lid panels completely closing the top of the container.
Figure 14:
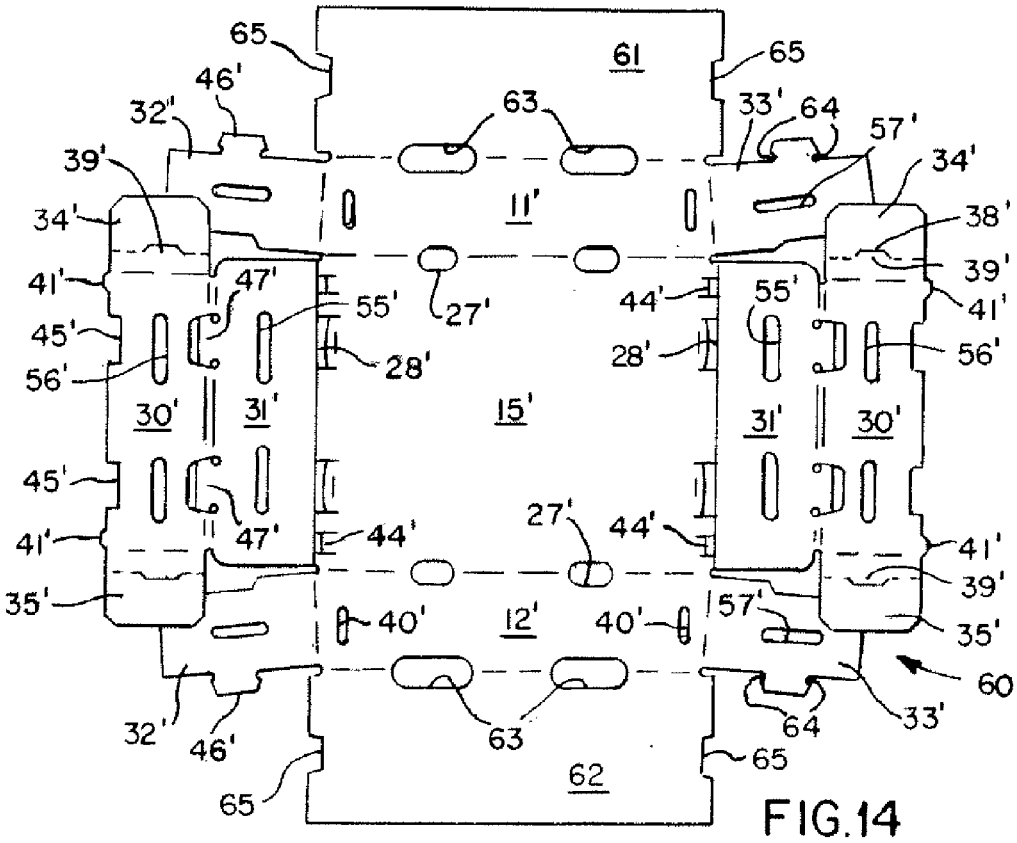
FIG. 14 is a top plan view of a blank for making the container of FIG. 13.
Figure 15:
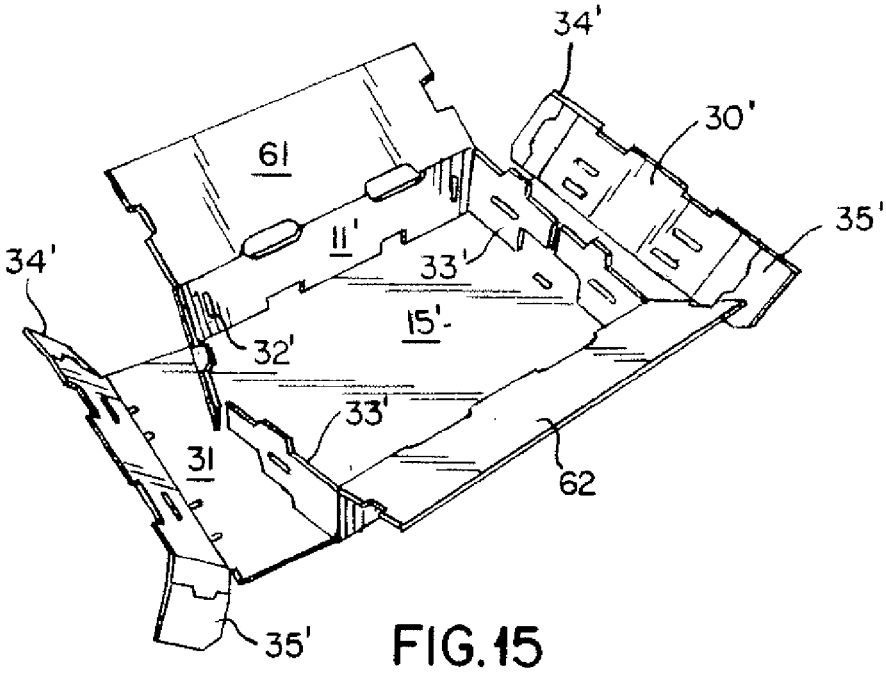
FIG. 15 is a top perspective view of the blank of FIG. 14, shown in a first stage of set-up, with the side walls and associated extension flaps folded upwardly and inwardly preparatory to folding the end walls and associated inner roll-over flaps into operative position.
Figure 16:
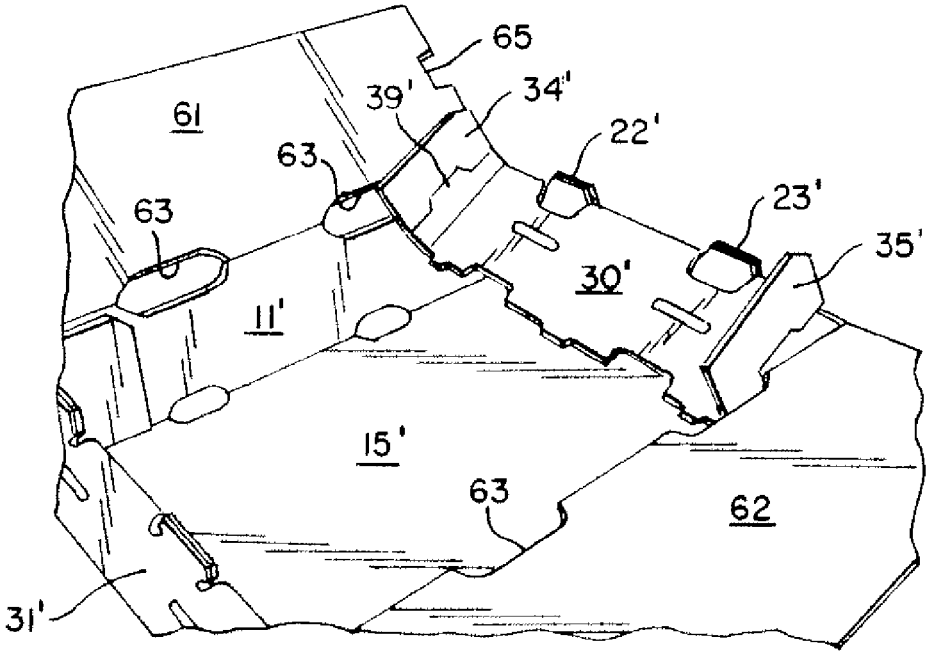
FIG. 16 is a top perspective view of the container of FIG. 13, with one end wall set up and the inner roll-over panel of the other end wall being moved into operative, set-up position, and with the lid panels in open position prior to being folded inwardly to close the top of the container.
Figure 17:
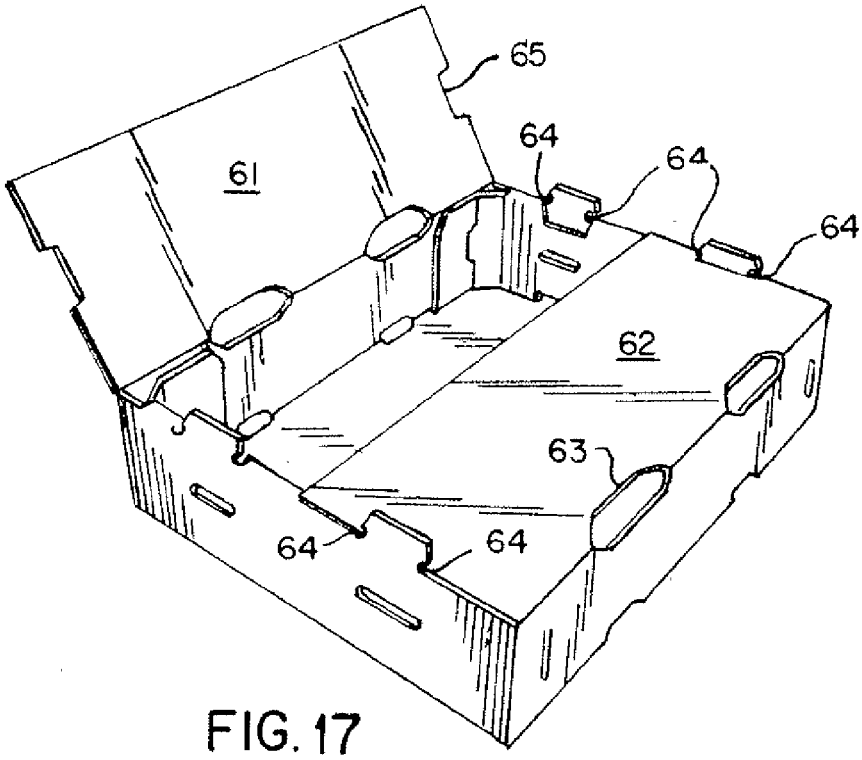
FIG. 17 is a top perspective view of the container of FIG. 16, with the ends set up and one lid panel folded inwardly into closed position over the top of the container.
Figure 18:
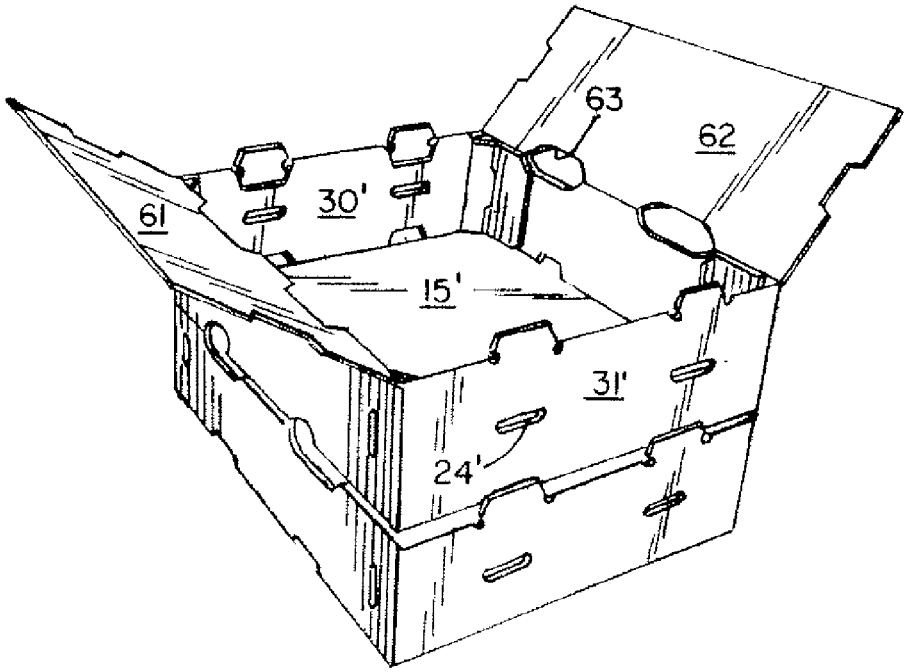
FIG. 18 is a top perspective view of two of the containers of FIG. 13 in stacked relationship and with the lid panels of the top container in open position.

As seen best in FIG. 2, the fold joining the extension flaps 32 and 33 to the respective side walls is angled away from the adjacent end wall. Accordingly, when the container is fully erected, the end walls carrying the stacking tabs, i.e., the indexing walls, are slightly inwardly inclined, e.g., at an angle of from about 2° to about 4° relative to the vertical. The side walls are essentially perpendicular to the bottom wall. This inward inclination of the indexing end walls provides space between abutting walls of contiguous containers for circulation of cooling air. It also properly positions the stacking tabs for insertion into the receiving slots in an upper container when the containers are stacked on top of one another.

The simple arrangement of panels, flaps and locking tabs, as described, requires less material than prior art containers of comparable structure and function, and the container thus formed is sturdy and reliably remains in erected position.

A second embodiment of the invention is indicated generally at 60 in FIGS. 13-18. This form of the invention is essentially the same as that previously described, including the inward inclination of the indexing walls, and like or similar components are identified with like reference characters primed. Therefore, a detailed description of all the components is not provided, since it is believed that the structure and function of the components of container 60 can readily be understood by reference to the drawings and comparison of the primed reference characters with those used in describing the previous embodiment.

The container 60 differs from that previously described primarily in that it has lid panels 61 and 62 that are folded inwardly over the top of the container from opposite sides to completely cover the top of the container. Further, ventilation openings 63 span the fold joining the lid panels to the side walls, and these ventilation openings extend into the lid panels and into the upper edges of the side walls.

It will be noted that the stacking tabs 20'-23' have undercut notches 64 formed in their side edges, and these notches cooperate with cut-outs 65 in the end edges of the inwardly folded lid panels to hold the lid panels in closed position. Additionally, the upper outer edges of the tabs are inwardly tapered at 66. These features are seen best in FIGS. 8 and 11, and facilitate movement of the edges of the lid panels past the tabs until the edges engage in the undercut notches. The tapered edges also facilitate insertion of the tabs into the slots 28 of an upper container when the containers are stacked.

In all other respects, the container 60 is constructed and functions essentially the same as the previously described embodiment.

Figure 19:
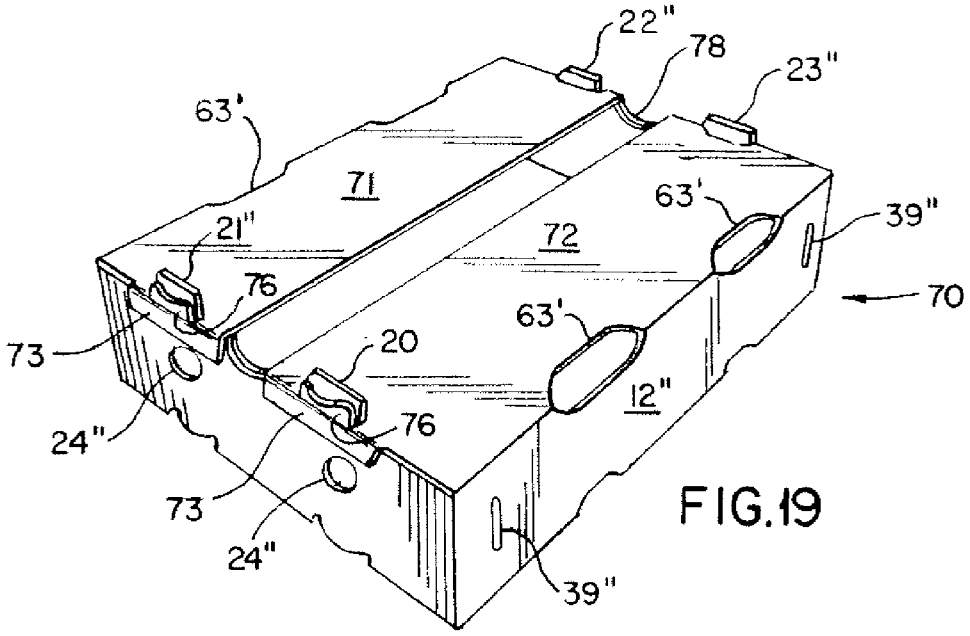
FIG. 19 is a top perspective view of a third embodiment of the container of the invention, with partial lid panels folded inwardly to partially close the open top of the container.
Figure 20:
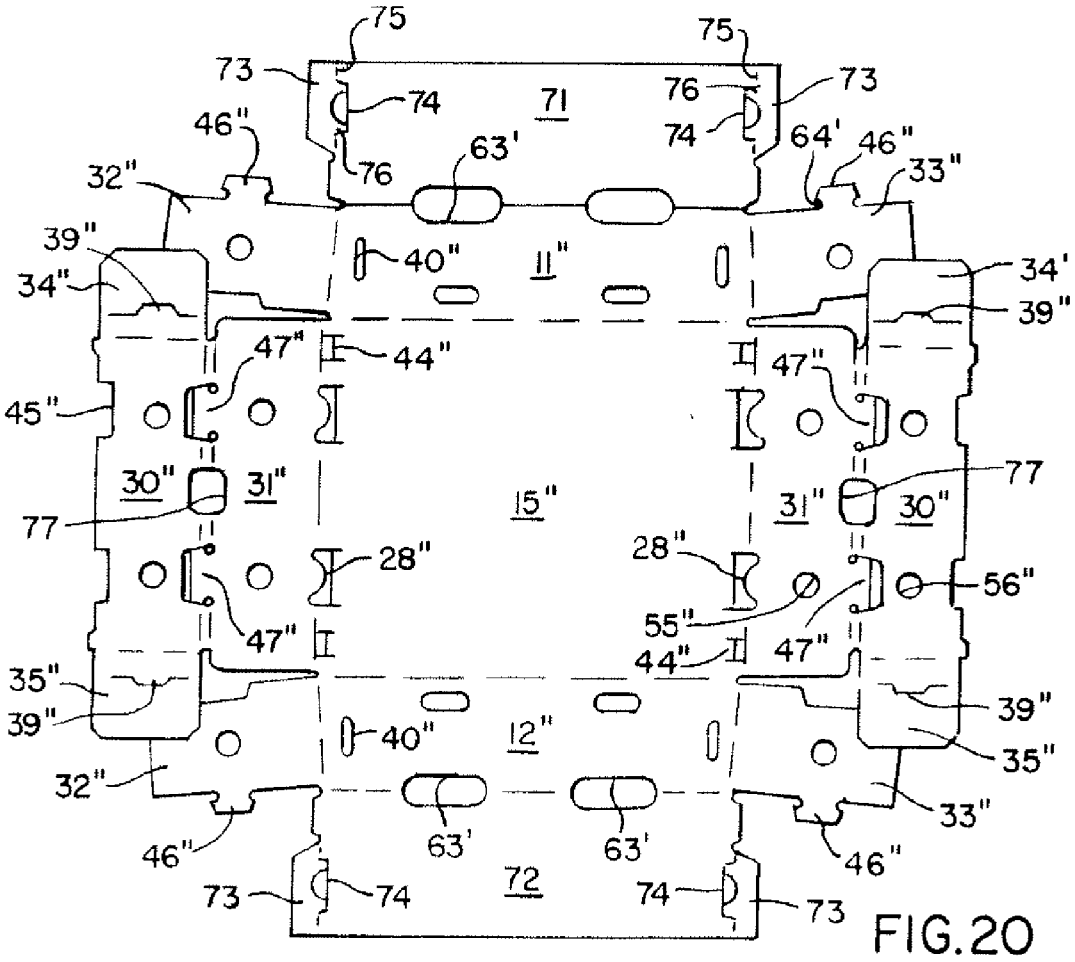
FIG. 20 is a top plan view of the blank for making the container of FIG. 19.
Figure 21:
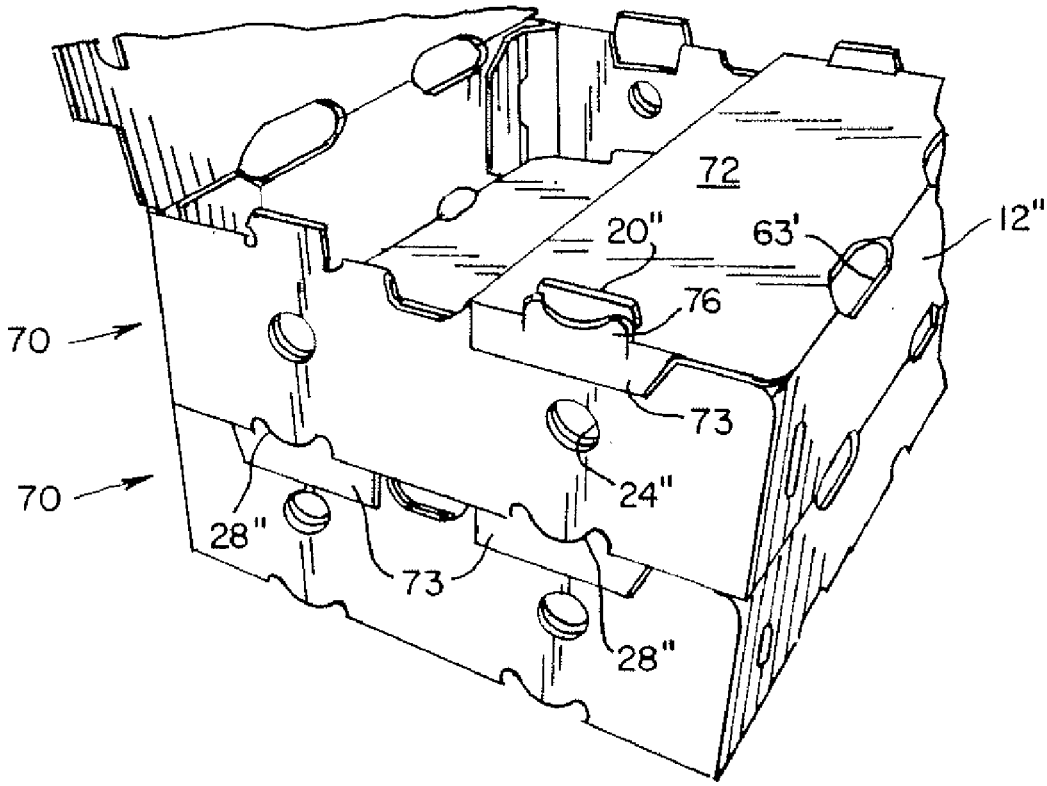
FIG. 21 is a top perspective view of two of the containers of FIG. 19 in stacked relationship, and showing the locking flaps or tabs on the ends of the lid panel, that fold downwardly over the outside of the adjacent end wall to more positively retain the lid panel in its operative, inwardly folded, closed position.

A third embodiment of the invention is indicated generally at 70 in FIGS. 19-21. This form of the invention is essentially the same as that shown in FIGS. 13-18, except that the lid panels 71 and 72 extend only part way across the top of the container when the lid panels are closed, and bendable flaps 73 on the ends of the lid panels fold down to lie against the outer surface of the end wall when the lid panels are closed. A shaped cut 74 at the fold 75 joining the respective flaps 73 to an associated lid panel defines a reversely extending heel tab 76 that projects upwardly from each flap to lie against an outer surface of an adjacent stacking tab 20"-23". In addition, a cut-out 77 spans the fold between the inner and outer roll-over panels 30", 31" to form a recessed ventilation opening 78 in the top edge of each end wall in an area lying between the confronting edges of the lid panels when they are in closed position. Further, the ventilation openings 24" in the end walls are circular in shape rather than elongate as in the previous embodiments. In this regard, the ventilation openings can have any desired shape and size to accomplish the purpose. Like elements are referred to by like reference characters primed or double primed, depending upon whether they were primed in FIGS. 13-18. A detailed description is not provided since it is believed that this embodiment can be clearly and easily understood by reference to the drawings and comparison of the double primed reference characters with the drawings and description of the previous embodiment.

While particular embodiments of the invention have been illustrated and described in detail herein, it should be understood that various changes and modifications may be made to the invention without departing from the spirit and intent of the invention as defined by the scope of the appended claims.

What is claimed is:

1. A stackable container folded from a single unitary blank of paperboard, comprising:

a bottom wall, opposite end walls, and opposite side walls;

said side walls foldably joined to opposite sides of said bottom wall;

said end walls each comprising an outer roll-over panel and an inner roll-over panel, said outer roll-over panels foldably joined along a first edge to a respective adjacent edge of the bottom wall, and said inner roll-over panels foldably joined along a first edge to a second edge of a respective outer roll-over panel, said inner and outer roll-over panels, in their operative positions, being folded into closely adjacent, parallel, overlying relationship to one another so that the outer roll-over panels form outer end wall panels and the inner roll-over panels form inner end wall panels;

first securing means securing the inner and outer roll-over panels in their operative positions;

first extension flaps foldably joined to opposite ends of the inner roll-over panels, said first extension flaps lying alongside an inner surface of respective adjacent side walls;

second securing means securing the first extension flaps in position alongside the inner surfaces of the respective side walls; and second extension flaps foldably joined to opposite ends of the side walls, said second extension flaps being captured between the inner and outer roll-over panels.

2. A container as claimed in claim 1, wherein:

spaced stacking tabs are on an upper edge of the end walls, and openings are in an end edge of the bottom wall and a lower edge of the end walls in positions to register with the stacking tabs when the container is stacked on top of another container, whereby the stacking tabs extend into the openings to index the respective slacked containers into properly aligned relationship and to positively retain them in stable stacked relationship.

3. A container as claimed in claim 2, wherein:

the stacking tabs are of two ply construction, comprising a first tab projecting upwardly from an upper edge of the respective outer roll-over panel, and a reinforcing second tab projecting upwardly from an upper edge of the captured second extension flaps and lying against said first tab.

4. A container as claimed in claim 1, wherein:

said first extension flaps are joined to the inner roll-over panels by closely spaced parallel fold lines positioned so that when said first extension flaps are folded to lie against said inner surface of the respective side wall, the fold lines define diagonal corner panels that lends stacking strength to the container.

5. A container as claimed in claim 1, wherein:

the end walls are inwardly inclined by about 2° to about 4° relative to the vertical to provide space for circulation of air when two containers are arranged in end-to-end abutting relationship with one another.

6. A container as claimed in claim 1, wherein:

ventilation openings are formed through at least some of said side and end walls to provide for circulation of air through the container.

7. A container as claimed in claim 6, wherein:

the ventilation openings include recessed areas in an upper edge of the side walls.

8. A container as claimed in claim 1, wherein:

a lid panel is foldably joined to an upper edge of each side wall, and said lid panels are folded inwardly over the container to form at least a partial lid.

9. A container as claimed in claim 2, wherein:

a lid panel is foldably joined to an upper edge of each side wall, said lid panels being folded inwardly over the container to form at least a partial lid; and side edges of each lid panel are adapted to frictionally engage an adjacent edge of the stacking tab to hold the partial lid panels in closed position.

10. A container as claimed in claim 9, wherein:

the stacking tabs are of two ply construction, comprising a first tab projecting upwardly from an upper edge of the respective outer roll-over panel, and a reinforcing second tab projecting upwardly from an upper edge of the second extension flap and lying against said first tab, said first tab having a greater width than said second tab; and an undercut notch is formed in said adjacent edge of said first stacking tab immediately adjacent an upper edge of the associated end wall to provide a positive detent holding said partial lid in closed position.

11. A container as claimed in claim 1, wherein:

said first and second securing means comprise interengaged detent tabs and slots to latch the inner roll-over panels and the first extension flaps in operative position, said interengaged detent tabs and slots enabling said container to be set-up by hand without requiring the use of adhesives.

12. A container as claimed in claim 11, wherein:

said detent tabs include a plurality of spaced apart first detent tabs projecting from a lower edge of the inner roll-over panels for cooperation with aligned slots formed in an edge portion of the bottom wall, and a second detent tab projecting from each said first extension flap toward the adjacent side wall for cooperation with a slot formed in said adjacent side wall.

13. A container as claimed in claim 12, wherein:

said first extension flaps are joined to the inner roll-over panels by closely spaced parallel fold lines positioned so that when the first extension flap is folded to lie against the inner surface of the end wall, the closely spaced parallel fold lines define a diagonal corner panel that lends stacking strength to the container; and said second detent tabs are formed by cuts made in said first extension flaps so that said second detent tabs extend parallel to the plane of a respective diagonal corner panel and toward said adjacent side wall, and project beyond said first extension flaps and into an associated said slot in said adjacent side wall.

14. A container as claimed in claim 1, wherein:

spaced stacking tabs are on an upper edge of the end walls, and openings are in an end edge of the bottom wall in positions to register with the stacking tabs when the containers are stacked on top of one another, whereby the stacking tabs extend into the openings to positively retain the stacked containers in stable stacked relationship, said stacking tabs being of two ply construction, comprising a first tab projecting upwardly from an upper edge of the associated outer roll-over panel, and a reinforcing second tab projecting upwardly from an upper edge of the associated second extension flap and lying against said first tab;

said first extension flaps are joined to the inner roll-over panels by closely spaced parallel fold lines positioned so that when the first extension flaps are folded to lie against said inner surface of said side walls the fold lines define diagonal corner panels that lend stacking strength to the container;

said end walls are inwardly inclined by about 2° to about 4° relative to vertical to provide space for circulation of air when two containers are arranged in end-to-end abutting relationship with one another; and ventilation openings are formed through at least some of said side and end walls to provide for circulation of air through the container.

15. A container as claimed in claim 14, wherein:

a lid panel is foldably joined to an upper edge of each side wall, said lid panels being folded inwardly over the container to form at least a partial lid; and a side edge of each lid panel is adapted to frictionally engage an adjacent edge of the stacking tab to hold the lid panels in closed position.

16. A container as claimed in claim 15, wherein:

said first tabs have a greater width than said second tabs; and an undercut notch is formed in an edge of each said stacking tab immediately adjacent an upper edge of the associated end wall to provide a positive detent for engaging and holding an edge of said lid panels.

17. A container as claimed in claim 16, wherein:

said first and second securing means comprise interengaged detent tabs and slots to latch said inner roll-over panels and said first extension flaps in operative position, said interengaged detent tabs and slots enabling said container to be set-up by band without requiring the use of adhesives.

18. A container as claimed in claim 17, wherein:

said detent tabs include a plurality of spaced apart first detent tabs projecting from a lower edge of said inner roll-over panels for cooperation with aligned slots formed in an edge portion of the bottom wall, and a second detent tab projecting from each said first extension flap toward the adjacent side wall for cooperation with a slot formed in said adjacent side wall, said second detent tab being formed by cuts made in the first extension flaps so that said second detent tabs extend parallel to the plane of an associated diagonal corner panel and toward an adjacent said side wall, and project beyond an associated first extension flap and into the slot in said adjacent side wall.

19. The container as claimed in claim 1, wherein said side walls have a length that is greater than said end walls.

* * * * *